US007509210B2

(12) United States Patent
Tsuda et al.

(10) Patent No.: US 7,509,210 B2
(45) Date of Patent: Mar. 24, 2009

(54) ABNORMALITY DETERMINATION APPARATUS AND METHOD FOR BLOW-BY GAS FEEDBACK DEVICE, AND ENGINE CONTROL UNIT

(75) Inventors: Masaki Tsuda, Saitama-ken (JP); Atsushi Izumiura, Saitama-ken (JP); Eisaku Gosyo, Saitama-ken (JP); Hirofumi Hara, Saitama-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 19 days.

(21) Appl. No.: 11/896,341

(22) Filed: Aug. 31, 2007

(65) Prior Publication Data

US 2008/0058994 A1 Mar. 6, 2008

(30) Foreign Application Priority Data

Sep. 1, 2006 (JP) ..... 2006-238056

(51) Int. Cl.
*F01M 13/00* (2006.01)

(52) U.S. Cl. ..... 701/114; 73/118.02

(58) Field of Classification Search ..... 701/114, 701/115, 102, 101; 73/118.02
See application file for complete search history.

(56) References Cited

U.S. PATENT DOCUMENTS 6,983,735 B2 * 1/2006 Toyoshima et al. .... 123/339.15
7,021,298 B2 * 4/2006 Nakazawa et al. ..... 123/568.14
2001/0010214 A1 8/2001 Maegawa et al.
2001/0047801 A1 12/2001 Baeuerle et al.

FOREIGN PATENT DOCUMENTS

EP 1 512 856 A2 3/2005
EP 1 520 974 A1 4/2005

* cited by examiner

*Primary Examiner*—Hieu T Vo
(74) *Attorney, Agent, or Firm*—Arent Fox LLP

(57) ABSTRACT

An abnormality determination apparatus and method for a blow-by gas feedback device, and an engine control unit are provided for improving the accuracy of abnormality determination even when an intake air amount controller is provided in an intake system at a location downstream of a joint of a blow-by gas passage. The blow-by gas feedback device feeds a blow-by gas back to an intake system of an internal combustion engine through a blow-by gas passage connected to the intake system through a joint. The abnormality determination apparatus comprises an intake air amount sensor provided in the intake system at a location upstream of the joint for detecting an intake air amount, an intake air amount controller provided in the intake system at a location downstream of the joint for controlling the intake air amount, and an ECU for determining an abnormality of the blow-by gas feedback device based on the intake air amount detected by the intake air amount sensor after the intake air amount has changed due to the operation of the intake air amount controller.

21 Claims, 7 Drawing Sheets

FIG. 4
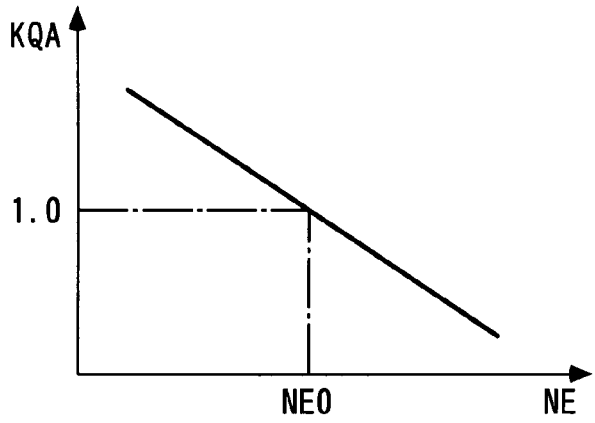
FIG. 5A
FIG. 5B
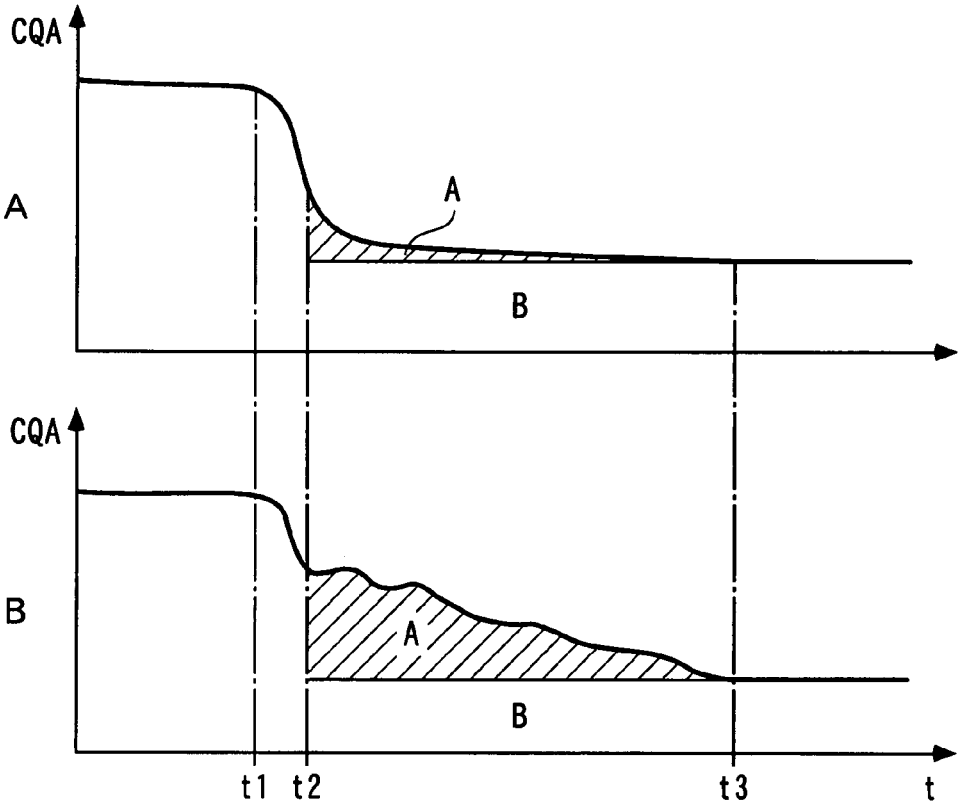

ABNORMALITY DETERMINATION APPARATUS AND METHOD FOR BLOW-BY GAS FEEDBACK DEVICE, AND ENGINE CONTROL UNIT

BACKGROUND OF THE INVENTION

1. Field of the Invention

The present invention relates to an abnormality determination apparatus and method for a blow-by gas feedback device for feeding a blow-by gas to an intake system of an internal combustion engine through a blow-by gas passage connected to the intake system, and an engine control unit.

2. Description of the Prior Art

Conventionally, as this type of abnormality determination apparatus for a blow-by gas feedback device, one described, for example, in Laid-open Japanese Patent Application No. 10-184335 is known. In Laid-open Japanese Patent Application No. 10-184335, a throttle valve is provided in an intake pipe of an internal combustion engine, and a bypass passage is connected to the intake pile for bypassing the throttle valve. An ISC valve is provided in the bypass passage to control the rotational speed of the internal combustion engine to a target rotational speed during an idle operation of the engine by controlling the amount of intake air. A blow-by gas passage is connected to the intake pipe at a location downstream of the throttle vale. This abnormality determination apparatus detects the opening of the ISC valve during the idle operation, and determines that the blow-by gas feedback device is abnormal by some cause such as the blow-by gas passage coming off the intake pipe, a damage, or the like, when the detected opening is smaller than a predetermined determination value.

Abnormalities of the blow-by gas feedback device are determined in this way for the reason set forth below. Specifically, when the blow-by gas passage comes off or is damaged, air flows into the intake pipe from such a location, so that the amount of intake air correspondingly increases, resulting in a rise in the rotational speed of the internal combustion engine beyond the target rotational speed. Associatively, the opening of the ISC valve is controlled to a smaller value than that during a normal operation for reducing the intake air amount in order for the increased rotational speed to converge to the target rotational speed. As a result, the opening is smaller than the determination value.

However, when the conventional abnormality determination apparatus described above is applied to a blow-by gas feedback device which has a blow-by gas passage connected to an intake pipe at a location upstream of a throttle valve, even if the blow-by gas passage comes off or is damaged, causing air to flow in from such a location, the opening of the ISC valve is controlled including the amount of the inflow air. As a result, the opening of the ISC valve is controlled in the same manner irrespective of whether the blow-by gas feedback device is abnormal or normal, so that abnormalities of the blow-by gas feedback apparatus cannot be appropriately determined based on the opening of the ISC valve.

SUMMARY OF THE INVENTION

The present invention has been made to solve the problems as mentioned above, and it is an object of the invention to provide an abnormality determination apparatus and method for a blow-by gas feedback device, and an engine control unit which are capable of improving the accuracy of abnormality determination even when an intake air amount controller is provided in an intake system at a location downstream of a joint of a blow-by gas passage.

To achieve the above object, according to a first aspect of the present invention, there is provided an abnormality determination apparatus for a blow-by gas feedback device for feeding a blow-by gas back to an intake system of an internal combustion engine through a blow-by gas passage connected to the intake system through a joint. The abnormality determination apparatus is characterized by comprising an intake air amount sensor provided in the intake system at a location upstream of the joint for detecting an intake air amount; an intake air amount controller provided in the intake system at a location downstream of the joint for controlling the intake air amount; and abnormality determining means for determining an abnormality of the blow-by gas feedback device based on the intake air amount detected by the intake air amount sensor after the intake air amount has changed due to the operation of the intake air amount controller.

According to this abnormality determination apparatus for a blow-by gas feedback device, the blow-by gas passage is connected to the intake system of the internal combustion engine through a joint, and the intake air amount is detected by the intake air amount sensor provided at a location upstream of the joint of the blow-by gas passage (hereinafter simply called "upstream"), while the intake air amount is controlled by the intake air amount controller provided at a location downstream of the joint of the intake system (hereinafter simply called "downstream"). The abnormality determining means determines an abnormality of the blow-by gas feedback device based on the upstream intake air amount detected by the intake air amount sensor after the downstream intake air amount has changed due to the operation of the intake air amount controller.

As the downstream intake air amount changes due to the operation of the intake air amount controller, the upstream intake air amount changes well in response to the changing downstream intake air amount to match with the downstream intake air amount in a relatively short time when the blow-by gas feedback device is normal. On the other hand, when the blow-by gas feedback device is abnormal due to the blow-by gas passage coming of f, damages of the blow-by gas passage, and the like, air flows into or flows out from that location, so that the upstream intake air amount presents different behaviors from those in normal operations, such as a lower responsibility of the upstream intake air temperature, the upstream intake air temperature not matching with the downstream intake air temperature, and the like. According to the present invention, since an abnormality of the blow-by gas feedback device is determined based on the upstream intake air amount detected after the downstream intake air amount has changed, the determination can be appropriately made to improve the determination accuracy.

Also, since an intake air amount sensor (air flow meter) is generally provided at a location upstream of the intake system, the abnormality determination can be made utilizing such an existing intake air amount sensor without adding a dedicated device for the determination.

To achieve the above object, according to a second aspect of the present invention, there is provided an abnormality determination method for a blow-by gas feedback device for feeding a blow-by gas back to an intake system of an internal combustion engine through a blow-by gas passage connected to the intake system through a joint. The abnormality determination method is characterized by comprising the steps of detecting an intake air amount by an intake air amount sensor provided in the intake system at a location upstream of the joint; controlling the intake air amount by an intake air amount controller provided in the intake system at a location downstream of the joint; and determining an abnormality of the blow-by gas feedback device based on the intake air amount detected by the intake air amount sensor after the intake air amount has changed due to the operation of the intake air amount controller.

This method provides the same advantageous effects as described above concerning the abnormality determination apparatus according to the first aspect of the invention.

To achieve the above object, according to a third aspect of the present invention, there is provided an engine control unit including a control program for determining an abnormality of a blow-by gas feedback device for feeding a blow-by gas back to an intake system of an internal combustion engine through a blow-by gas passage connected to the intake system through a joint. The engine control unit is characterized in that the control program causes a computer to detect an intake air amount by an intake air amount sensor provided in the intake system at a location upstream of the joint; control the intake air amount by an intake air amount controller provided in the intake system at a location downstream of the joint; and determine an abnormality of the blow-by gas feedback device based on the intake air amount detected by the intake air amount sensor after the intake air amount has changed due to the operation of the intake air amount controller.

This engine control unit provides the same advantageous effects as described above concerning the abnormality determination apparatus according to the first aspect of the invention.

Preferably, in the abnormality determination apparatus for a blow-by gas feedback device described above, the abnormality determining means comprises changing degree calculating means for calculating a changing degree of the intake air amount based on the intake air amount detected after the intake air amount has changed; and the abnormality determining means determines an abnormality of the blow-by gas feedback device based on the changing degree of the intake air amount calculated after the intake air amount has changed to decrease.

When the intake air amount changes to decrease, part of a larger amount of intake air, which has been so far flowing through the intake system, initially loses where to go, and flows out from a location at which the blow-by gas passage comes off, and the like, so that the intake air amount slowly decreases, if the blow-by gas passage comes off or is damaged. According to this preferred embodiment of the abnormality determination apparatus, since a changing degree of the intake air amount after the intake air amount has changed to decrease is calculated by the changing degree calculating means, and an abnormality of the blow-by gas feedback device is determined based on the calculated changing degree of the upstream intake air amount, the determination can be appropriately made.

Preferably, in the abnormality determination method for a blow-by gas feedback device described above, the step of determining an abnormality includes calculating a changing degree of the intake air amount based on the intake air amount detected after the intake air amount has changed; and determining an abnormality of the blow-by gas feedback device based on the changing degree of the intake air amount calculated after the intake air amount has changed to decrease.

This preferred embodiment of the abnormality determination method provides the same advantageous effects as described above concerning the abnormality determination apparatus according to the first aspect of the invention.

Preferably, in the engine control unit described above, the control program further causes the computer to calculate a changing degree of the intake air amount based on the intake air amount detected after the intake air amount has changed; and determine an abnormality of the blow-by gas feedback device based on the changing degree of the intake air amount calculated after the intake air amount has changed to decrease.

This preferred embodiment of the engine control unit provides the same advantageous effects as described above concerning the abnormality determination apparatus according to the first aspect of the invention.

Preferably, in the abnormality determination apparatus for a blow-by gas feedback device described above, the abnormality determining means comprises changing degree calculating means for calculating a changing degree of the intake air amount based on the intake air amount detected after the intake air amount has changed; and the abnormality determining means determines an abnormality of the blow-by gas feedback device based on the changing degree of the intake air amount calculated immediately after the intake air amount has changed to increase.

As the intake air amount changes to increase, the upstream intake air amount abruptly increases (rises) immediately after the change. When the blow-by gas passage comes off or is damaged, air flows into from such a location, and the upstream intake air amount correspondingly decreases, resulting in a smaller rising amount. According to this preferred embodiment of the abnormality determination apparatus, since the changing degree is calculated immediately after the intake air amount changes to increase, and an abnormality of the blow-by gas feedback apparatus is determined based on the calculated changing degree, the determination can be appropriately made.

Preferably, in the abnormality determination method for a blow-by gas feedback device described above, the step of determining an abnormality includes calculating a changing degree of the intake air amount based on the intake air amount detected after the intake air amount has changed; and determining an abnormality of the blow-by gas feedback device based on the changing degree of the intake air amount calculated immediately after the intake air amount has changed to decrease.

This preferred embodiment of the abnormality determination method provides the same advantageous effects as described above concerning the abnormality determination apparatus according to the first aspect of the invention.

Preferably, in the engine control unit described above, the control program further causes the computer to calculate a changing degree of the intake air amount based on the intake air amount detected after the intake air amount has changed; and determine an abnormality of the blow-by gas feedback device based on the changing degree of the intake air amount calculated immediately after the intake air amount has changed to increase.

This preferred embodiment of the engine control unit provides the same advantageous effects as described above concerning the abnormality determination apparatus according to the first aspect of the invention.

Preferably, in the abnormality determination apparatus for a blow-by gas feedback device described above, the changing degree calculating means calculates an accumulation value of the intake air amount detected in a predetermined period after the intake air amount has changed as a parameter indicative of the changing degree of the intake air amount; and the abnormality determining means determines an abnormality of the blow-by gas feedback device based on the calculated accumulation value of the intake air amount.

According to this preferred embodiment of the abnormality determination apparatus, the changing degree calculating means calculates an accumulation value of the intake air amount detected in the predetermined period after the intake air amount has changed as a parameter indicative of the changing degree of the intake air amount, and an abnormality of the blow-by gas feedback device is determined based on the calculated accumulation value of the intake air amount. Thus, since the accumulation value of the intake air amount is used as a parameter indicative of the changing degree of the intake air amount, it is possible to prevent erroneous determinations due to temporary fluctuations in the intake air amount, the influence of noise included in a detection signal of the intake air amount, and the like, to further improve the determination accuracy.

Preferably, in the abnormality determination method for a blow-by gas feedback device described above, step of determining an abnormality includes calculating an accumulation value of the intake air amount detected in a predetermined period after the intake air amount has changed as a parameter indicative of the changing degree of the intake air amount; and determining an abnormality of the blow-by gas feedback device based on the calculated accumulation value of the intake air amount.

This preferred embodiment of the abnormality determination method provides the same advantageous effects as described above concerning the abnormality determination apparatus according to the first aspect of the invention.

Preferably, in the engine control unit described above, the control program further causes the computer to calculate an accumulation value of the intake air amount detected in a predetermined period after the intake air amount has changed as a parameter indicative of the changing degree of the intake air amount; and determine an abnormality of the blow-by gas feedback device based on the calculated accumulation value of the intake air amount.

This preferred embodiment of the engine control unit provides the same advantageous effects as described above concerning the abnormality determination apparatus according to the first aspect of the invention.

Preferably, the abnormality determination apparatus for a blow-by gas feedback device described above further comprises rotational speed detecting means for detecting a rotational speed of the internal combustion engine; and an intake air amount correcting means for correcting the detected intake air amount to be smaller as the detected rotational speed is higher.

The intake air amount differs depending on the rotational speed of the internal combustion engine, and is larger, for example, as the rotational speed is higher. Accordingly, even if the rotational speed of the internal combustion engine changes, for example, during accumulation of the intake air amount, the intake air amount can be found based on a predetermined rotational speed of the internal combustion engine. Thus, the accuracy can be further improved by making the abnormality determination based on the thus corrected intake air amount.

Preferably, the abnormality determination method for a blow-by gas feedback device described above further comprises the steps of detecting a rotational speed of the internal combustion engine; and correcting the detected intake air amount to be smaller as the detected rotational speed is higher.

This preferred embodiment of the abnormality determination method provides the same advantageous effects as described above concerning the abnormality determination apparatus according to the first aspect of the invention.

Preferably, in the engine control unit described above, the control program further causes the computer to detect a rotational speed of the internal combustion engine; and correct the detected intake air amount to be smaller as the detected rotational speed is higher.

This preferred embodiment of the engine control unit provides the same advantageous effects as described above concerning the abnormality determination apparatus according to the first aspect of the invention.

Preferably, the abnormality determination apparatus for a blow-by gas feedback device described above further comprises operating condition detecting means for detecting an operating condition of the internal combustion engine, wherein the abnormality determining means executes an abnormality determination for the blow-by gas feedback device when the detected operating condition is a predetermined operating condition.

According to this preferred embodiment of the abnormality determination apparatus, the abnormality determining means executes the abnormality determination for the blow-by gas feedback device when the detected operating condition of the internal combustion engine is a predetermined operating condition. When the operating condition of the internal combustion engine varies during the abnormality determination, the intake air amount can vary in response thereto, possibly resulting in a failure in appropriately making the abnormality determination based on the intake air amount. For this reason, by setting, for example, an operating condition associated with small variations in load as the predetermined operating condition of the internal combustion engine, the abnormality determination can be made only when the intake air amount is stable, thereby further improving the accuracy of the abnormality determination.

Preferably, the abnormality determination method for a blow-by gas feedback device described above further comprises the step of detecting an operating condition of the internal combustion engine; and executing an abnormality determination for the blow-by gas feedback device when the detected operating condition is a predetermined operating condition.

This preferred embodiment of the abnormality determination method provides the same advantageous effects as described above concerning the abnormality determination apparatus according to the first aspect of the invention.

Preferably, in the engine control unit described above, the control program further causes the computer to detect an operating condition of the internal combustion engine; and execute an abnormality determination for the blow-by gas feedback device when the detected operating condition is a predetermined operating condition.

This preferred embodiment of the engine control unit provides the same advantageous effects as described above concerning the abnormality determination apparatus according to the first aspect of the invention.

Preferably, in the abnormality determination apparatus for a blow-by gas feedback device described above, the intake air amount controller comprises a plurality of intake air amount controllers, and the apparatus further comprises a control means for controlling at least one of the plurality of intake air amount controllers to change the intake air amount, and holding remaining ones of the intake air amount controllers in a predetermined operating condition such that the remaining intake air amount controllers do not affect the intake air amount, when the abnormality determination is executed.

According to this preferred embodiment of the abnormality determination apparatus, at least one of the plurality of intake air amount controllers is controlled to change the intake air amount, while remaining ones of the intake air amount controllers are held in a predetermined operating condition such that the remaining intake air amount controllers do not affect the intake air amount. Thus, the abnormality determination can be made while eliminating the influence on the intake air amount exerted by operations of the other intake air amount controllers, to further improve the accuracy.

Preferably, in the abnormality determination method for a blow-by gas feedback device described above, the intake air amount controller comprises a plurality of intake air amount controllers; and the method further comprises the step of controlling at least one of the plurality of intake air amount controllers to change the intake air amount, and holding remaining ones of the intake air amount controllers in a predetermined operating condition such that the remaining intake air amount controllers do not affect the intake air amount, when the abnormality determination is executed.

This preferred embodiment of the abnormality determination method provides the same advantageous effects as described above concerning the abnormality determination apparatus according to the first aspect of the invention.

Preferably, in the engine control unit described above, the intake air amount controller comprises a plurality of intake air amount controllers, and the control program further causes the computer to control at least one of the plurality of intake air amount controllers to change the intake air amount, and holding remaining ones of the intake air amount controllers in a predetermined operating condition such that the remaining intake air amount controllers do not affect the intake air amount, when the abnormality determination is executed.

This preferred embodiment of the engine control unit provides the same advantageous effects as described above concerning the abnormality determination apparatus according to the first aspect of the invention.

BRIEF DESCRIPTION OF THE DRAWINGS

FIG. 4 is a table used in the process of FIG. 2 for calculating an intake air amount correction coefficient;

FIGS. 5A and 5B are diagrams showing exemplary changes in corrected intake air amount associated with opening control of an intake air throttle valve when the blow-by gas feedback device is normal (A) and abnormal (B);

DETAILED DESCRIPTION OF THE EMBODIMENT

Figure 1:
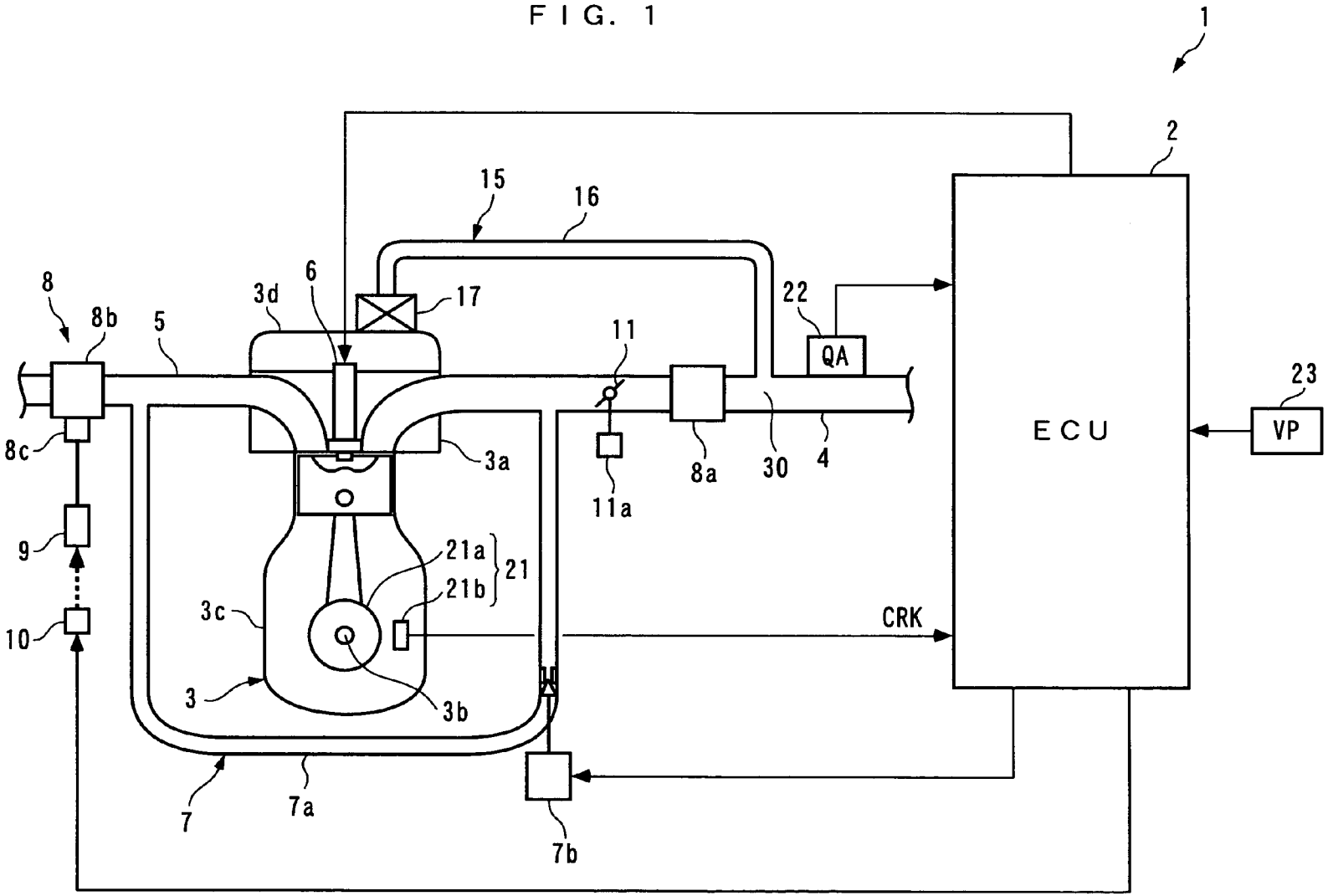
FIG. 1 is a diagram generally showing the configuration of an abnormality determination apparatus according to the present invention, and a blow-by gas feedback device and an internal combustion engine to which the abnormality determination apparatus is applied.

In the following, a preferred embodiment of the present invention will be described with reference to the drawings. FIG. 1 generally illustrates the configuration of an abnormality determination apparatus 1 according to one embodiment of the present invention, and a blow-by gas feedback device 15 and an internal combustion engine (hereinafter called the "engine") 3 to which the abnormality determination apparatus 1 is applied. The engine 3 is, for example, a four-cylinder (only one of which is shown) diesel engine equipped in a vehicle (not shown).

A cylinder head 3*a* of the engine 3 is connected to an intake pipe 4 (intake system) and an exhaust pipe 5, respectively, and a fuel injection valve (hereinafter called the "injector") 6 is attached to face a combustion chamber. A fuel injection amount QINJ and an injection timing of the injector 6 is controlled by an ECU 2, later descried.

A crank angle sensor 21 (rotational speed detecting means) is provided on a crank shaft 3*b* of the engine 3. The crank angle sensor 21 comprises a magnet rotor 21*a* and an MRE pickup 21*b*, and generates a CRK signal which is a pulse signal as the crank shaft 3*b* rotates. The CRK signal is outputted every predetermined crank angle (for example, every 1°), and the ECU 2 calculates an rotational speed NE of the engine 3 (hereinafter called the "engine rotational speed") based on the CRK signal.

The engine 3 is also provided with an EGR device (intake air amount controller) which has an EGR pipe 7*a* and an EGR control valve 7*b*. The EGR pipe 7*a* is connected to the intake pipe 4 and the exhaust pipe 5 so as to connect both. Part of exhaust gases of the engine 3 is fed back to the intake pipe 4 as an EGR gas through the EGR pipe 7*a*, thereby lowering a combustion temperature of the engine to reduce NOx in exhaust gases.

The EGR control valve 7*b* comprises a linear electromagnetic valve attached to the EGR pipe 7*a*. The duty ratio of a current supplied to the EGR control valve 7*b* is controlled by the ECU 2 to linearly control a valve lift amount, thereby adjusting the amount of fed-back EGR gas (hereinafter called the "EGR amount"). Specifically, as the duty ratio is larger, the valve lift amount increases, resulting in a larger EGR amount. When the duty ratio is zero, the EGR control valve 7*b* is controlled to fully close, resulting in the EGR amount equal to zero.

The engine 3 is further provided with a supercharger 8 (intake air amount controller) and an actuator 9 coupled to the supercharger 8. The supercharger 8 comprises a rotatable compressor blade 8*a* provided in the intake pipe 4 at a location upstream of a connection with the EGR pipe 7*a*; a rotatable turbine blade 8*b* and a plurality of pivotable variable vanes 8*c* provided in the exhaust pipe 5; and a shaft (not shown) which integrally couples the blades 8*a*, 8*b*. The supercharger 8 performs a supercharging operation for compressing intake air within the intake pipe 4 by the compressor blade 8*a* which is driven to rotate together with the turbine blade 8*b*, integrated therewith, which is driven to rotate by exhaust gases in the exhaust pipe 5.

The actuator 9 is of a diaphragm type which operates with a negative pressure, and is mechanically coupled to each variable vane 8*c*. The actuator 9 is supplied with a negative pressure from a negative pressure pump through a negative pressure supply passage (none of which is shown). A vane opening control valve 10 is provided halfway in the negative pressure supply passage. The vane opening control valve 10 comprises an electromagnetic valve, the opening of which is controlled by a driving signal from the ECU 2 to change the negative pressure supplied to the actuator 9. This causes the opening of the variable vane 8*c* (hereinafter called the "vane opening") to change, thereby controlling a super charge pressure. Specifically, as the vane opening is smaller, exhaust gases flow into the turbine blade 8*b* at a lower flow rate, resulting in a reduction in the supercharge pressure. When the vane opening is fully closed, the supercharge pressure is zero.

The blow-by gas feedback device 15 feeds a blow-by gas in a crank case 3*c* of the engine 3 back to the intake pipe 4 as appropriate, and comprises a blow-by gas passage 16 and a PCV valve 17.

The blow-by gas passage 16 has one end connected to a cylinder head cover 3*d* of the engine 3, and the other end connected to the intake pipe 4 at a location upstream of the compressor blade 8*a* through a joint 30. The engine 3 is formed with a breather passage (not shown) from the cylinder head 3*a* to a cylinder block, and the blow-by gas is fed back to the intake pipe 4 through the breather passage, the cylinder head cover 3*d* and the blow-by gas passage 16.

The PCV valve 17 is provided at a connection of the blow-by gas passage 16 with the cylinder head cover 3*d*. The PCV valve 17 comprises a mechanical valve, and opens when the difference between pressures upstream and downstream thereof increases beyond a predetermined pressure, thereby feeding the blow-by gas back to the intake pipe 4.

The intake pipe 4 is provided with an intake air throttle valve (intake air amount controller) between a connection with the EGR pipe 7*a* and the compressor blade 8*a* for adjusting the intake air amount. The intake air throttle valve 11 is connected to an actuator 11*a* which comprises, for example, a DC motor. The opening of the intake air throttle valve 11 is variably controlled between a fully close opening and a fully open opening by controlling the duty ratio of a current supplied to the actuator 11*a* by the ECU 2.

An air flow meter 22 (intake air amount sensor) is also provided in the intake pipe 3 at a location upstream of the joint 30 with the blow-by gas passage 16. The air flow meter 22 detects an intake air amount QA, and outputs its detection signal to the ECU 2.

The ECU 2 is applied with a detection signal indicative of a speed of the vehicle (hereinafter called the "vehicle speed") VP from a vehicle speed sensor 23.

The ECU 2 is based on a micro-computer which comprises an I/O interface, a CPU, a RAM, a ROM and the like. The detection signals from a variety of the aforementioned sensors 21-23 are inputted to the CPU after they have undergone A/D conversion and reshaping in the I/O interface.

The CPU determines the operating condition of the engine 3 in accordance with a control program and the like stored in the ROM in response to the input signals, controls the engine 3 including the fuel injection amount QINJ, and executes an abnormality determination process for the blow-by gas feedback device 15. In this embodiment, the ECU 2 implements abnormality determining means, changing degree calculating means, rotational speed detecting means, intake air amount correcting means, operating condition detecting means, and control means.

Figure 2:
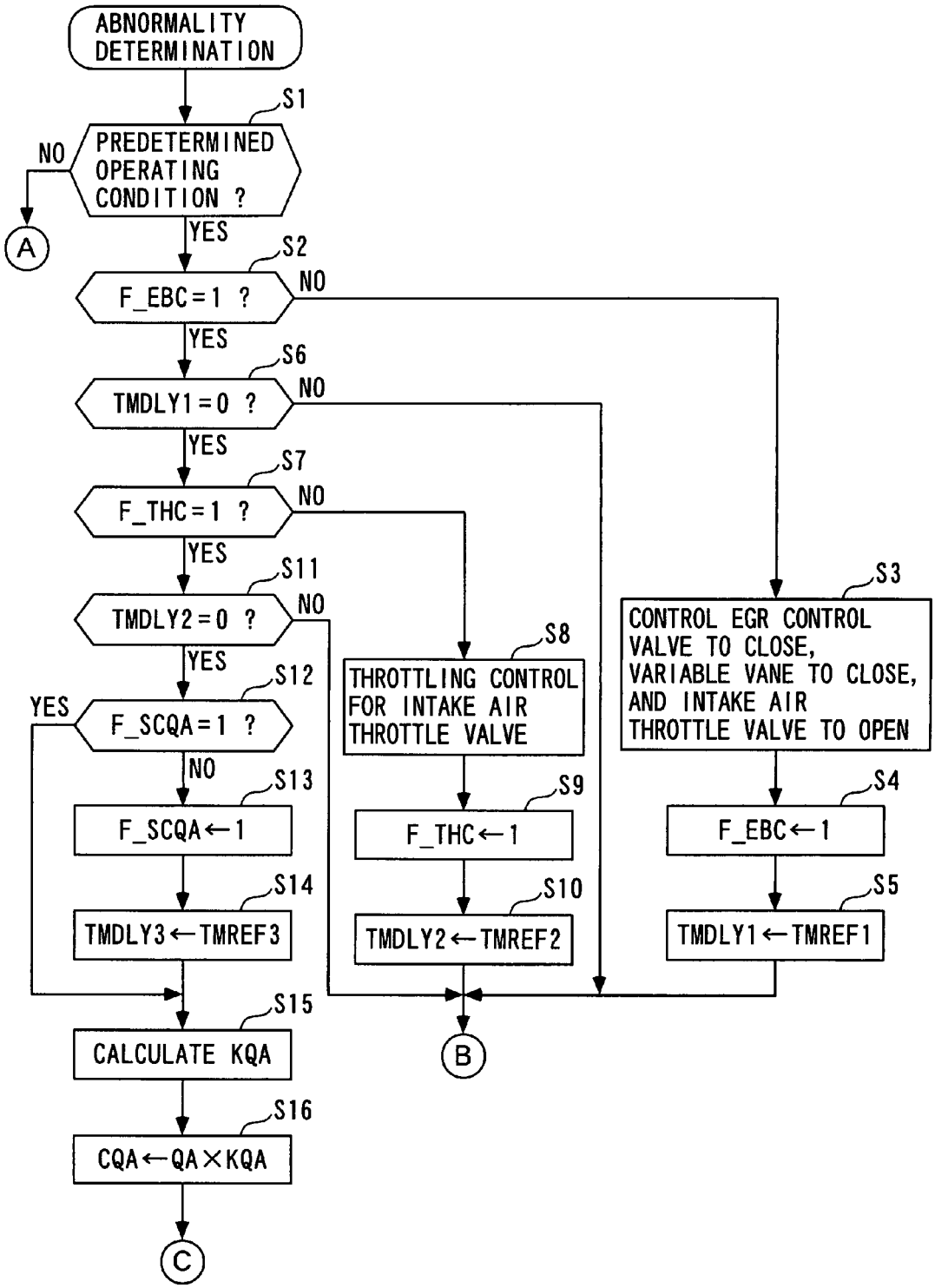
FIG. 2 is a flow chart showing an abnormality determination process for a blow-by gas feedback device according to a first embodiment of the present invention.
Figure 3:
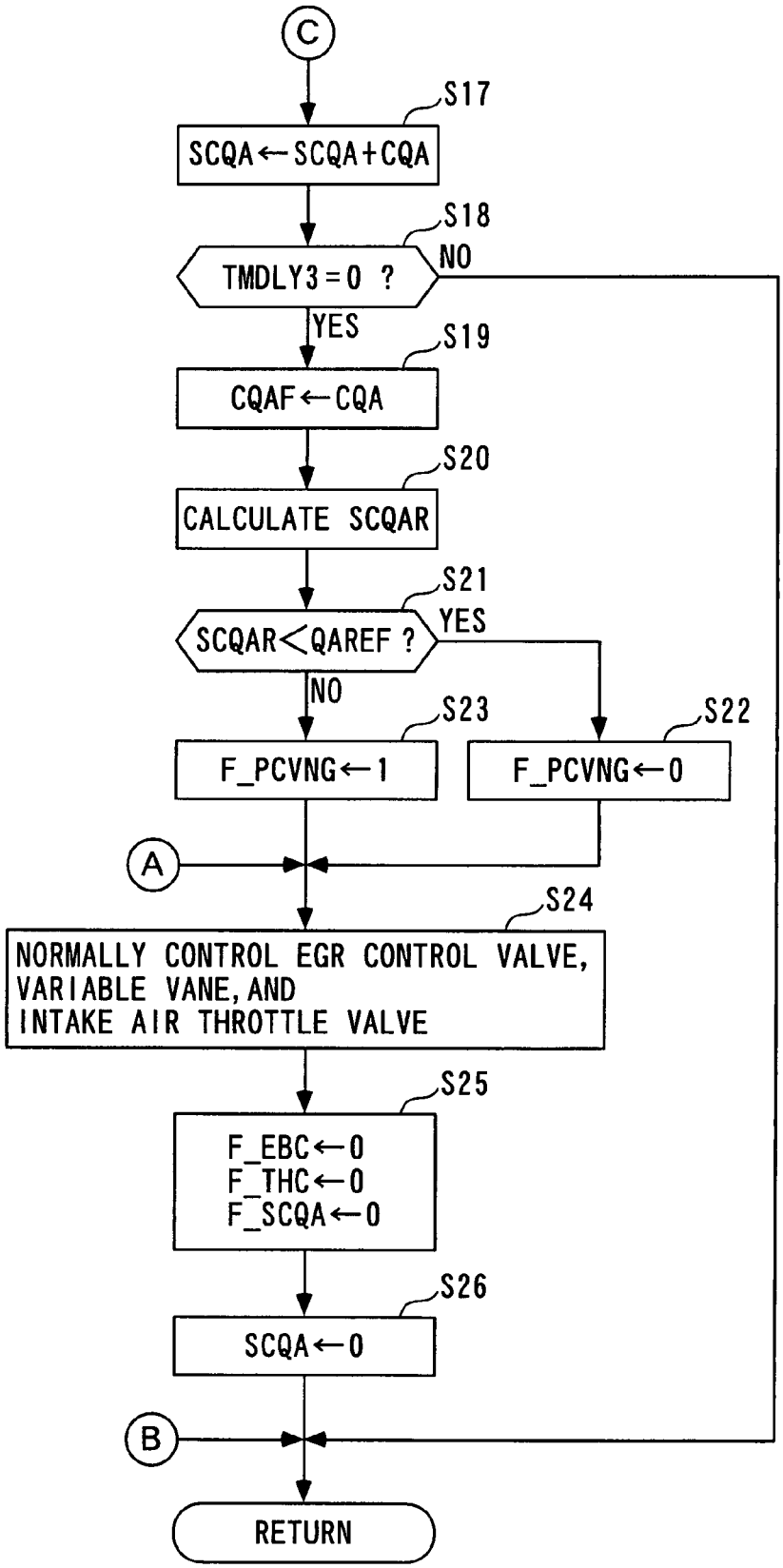
FIG. 3 is a flow chart continued from FIG. 2.

FIGS. 2 and 3 are flow charts showing the abnormality determination process for the blow-by gas feedback device 15 according to a first embodiment of the present invention. This process is executed every predetermined time. In this process, first at step 1 (abbreviated as "S1" in the figures. The same is applied to the following description), it is determined whether or not the engine 3 is in a predetermined operating condition. In this determination, the engine 3 is determined to be in the predetermined operating condition when the engine 3 is in a fuel cut operation in which a fuel supplied to the engine 3 is stopped, or when the engine 3 is in a cruising operation. Specifically, the fuel cut operation is determined when the fuel injection amount QINJ is substantially zero, and the cruising operation is determined when the fuel injection amount QINJ and the vehicle speed VP are substantially constant.

When the result of the determination at step 1 is NO, the EGR control valve 7*b*, the variable vane 8*c*, and the intake air throttle valve 11 are respectively controlled to be in their normal states (hereinafter called the "normal control") (step 24), and a valve close control flag F_EBC, a throttling control flag F_THC, and an accumulation flag F_SCQA are all set to "0" (step 25). In addition, a post-correction intake air amount accumulation value SCQA is reset to zero (step 26), followed by the termination of this process.

On the other hand, when the result of the determination at step 1 is YES, indicating that the engine 3 is in the predetermined operating condition, it is determined whether or not the valve close control flag F_EBC is "1" (step 2).

When the result of this determination is NO, the openings of the EGR control valve 7*b* and the variable vane 8*c* are held at predetermined small openings (for example, 0° and 5°, respectively) which do not affect the intake air amount at step 3 (hereinafter called the "valve closing control"), and the intake air throttle valve 11 is once controlled to a predetermined large opening (valve opening control). Next, the valve close control flag F_EBC is set to "1" (step 4), and a first timer value TMDLY1 of a down-count type delay timer (not shown) is set to a first predetermined time TMREF1 (for example 1.5 sec) (step 5), followed by the termination of this process.

When the aforementioned step 4 is executed, the result of the determination at step 2 is YES, in which case it is determined whether or not the first timer value TMDLY1 is zero (step 6). When the result of this determination is NO, this process is terminated.

On the other hand, when the result of the determination at step 6 is YES, i.e., when the valve closing control has continued for the first predetermined time TMREF1 for the EGR control valve 7*b* and variable vane 8*c*, it is determined whether or not the throttling control flag F_THC is "1" (step 7) on the assumption that the intake air amount has been stabilized.

When the result of this determination is NO, the intake air throttle valve 11 is controlled to a predetermined opening smaller than that in the normal control (hereinafter called the "throttling control"). In this way the intake air amount is controlled to decrease. The predetermined opening is controlled, for example, to a predetermined idle opening during a fuel cut operation, and to a predetermined opening larger than the idle opening during a cruising operation.

Next, the throttle valve control flag F_THC is set to "1" (step 9), and a second timer value TMDLY2 is set to a second predetermined time TMREF2 (for example, 0.3 sec) (step 10), followed by the termination of this process.

When the aforementioned step 9 is executed, the result of the determination at step 7 is YES, in which case it is determined whether or not the second timer value TMDLY2 is zero (step 11). When the result of this determination is NO, this process is terminated.

On the other hand, when the result of the determination at step 11 is YES, i.e., when the second predetermined time TMREF2 has elapsed after the start of the throttling control for the intake air throttle valve 11, it is determined whether or not the accumulation flag F_SCQA is "1" (step 12) on the assumption that no influence is exerted by response delays of the intake air throttle valve 11 and the intake air amount associated with the throttling control.

When the result of this determination is NO, the accumulation flag F_SCQA is set to "1" (step 13), a third timer value TMDLY3 is set to a third predetermined time TMREF3 (for example, 2.0 sec) (step 14), and the process goes to step 15.

Also, when the step 13 is executed, the result of the determination at step 12 is YES, in which case the flow goes directly to step 15.

At step 15, an intake air amount correction coefficient KQA is calculated by searching a table shown in FIG. 4 in accordance with the rotational speed NE. In this table, the intake air amount correction coefficient KQA is linearly set to a smaller value as the engine rotational speed NE is higher, and is set to 1.0 at a reference rotational speed NEO (for example, 1500 rpm).

Next, the post-correction intake air amount CQA is calculated by multiplying the intake air amount QA detected by the air flow meter 22 by the intake air amount correction coefficient KQA (step 16). This correction is intended for a conversion of the intake air amount QA to a value when the engine rotational speed NE is at the reference rotational speed NEO. This is because the intake air amount QA increases more as the engine rotational speed NE is higher.

Next, a current post-correction intake air amount accumulation value SCQA is calculated by adding the calculated post-correction intake air amount CQA to the preceding value of the post-correction intake air amount accumulation value SCQA (=SCQA+CQA) (step 17). Next, it is determined whether or not the third timer value TMDLY3 is zero (step 18). The third predetermined time TMREF3 is substantially equivalent to a time required for the intake air amount to converge to a constant value after the start of throttling control for the intake air control valve 11, and is found, for example, by experiments. When the result of this determination is NO, this process is terminated.

On the other hand, when the result of the determination at step 18 is YES, indicating that the third predetermined time TMREF3 has elapsed after the start of the calculation of the post-correction intake air amount accumulation value SCQA, the post-correction intake air amount CQA at that time is set as a final value CQAF (step 19) on the assumption that the intake air amount has been converged. Next, an intake air changing amount SCQAR is calculated in accordance with the next Equation (1) using the calculated post-correction intake air amount accumulation value SCQA and the final value CQAF (step 20):

$$SCQAR=SCQA-(CQAF\times N) \quad (1)$$

where N is the number of times of accumulation in the post-correction intake air amount accumulation value SCQA, and is calculated by dividing the third predetermined time TMREF3 by a period at which this process is executed.

Next, it is determined whether or not the calculated intake air changing amount SCQAR is smaller than a predetermined threshold value QAREF (step 21). When the result of this determination is YES, an abnormality flag F_PCVNG is set to "0" (step 22), on the assumption that the plow-by gas feedback device 15 is normal, followed by the execution of the aforementioned step 24.

On the other hand, when the result of the determination at step 21 is NO, indicating SCQAR≧QAREF, the intake air changing amount is large, and the blow-by gas feedback device 15 is determined to be abnormal on the assumption that air can be flowing due to the blow-by gas passage 16 which has come off the intake pipe 4, or the like. Then, the abnormality flag F_PCVNG is set to "1" for indicating this fact (step 23), followed by the execution of the aforementioned step 24.

FIGS. 5A and 5B show exemplary changes in the post-correction intake air amount CQA associated with the throttling control for the intake air throttle valve 11 when the blow-by gas feedback device 15 is normal (A) and when abnormal (B). The throttling control is started for the intake air throttle valve 11 (timing t1), the calculation of the post-correction intake air amount accumulation value SCQA is started when the second predetermined time TMREF2 has elapsed after the start of the throttling control (t2), and the calculation is terminated when the third predetermined time TMREF3 has elapsed from the start of the calculation (t3). Accordingly, the post-correction intake air amount accumulation amount SCQA is an accumulated value of the post-correction intake air amount CQA between t2 and t3, and corresponds to the area of a region A+B in FIG. 5. On the other hand, the area of a region B is equivalent to the final value CQAF multiplied by the number of times N of accumulations in the second term of Equation (1). As such, the intake air changing amount SCQA calculated at step 20 corresponds to the area of a region A, and represents a net changing amount in accordance with the throttling control except for a portion not related to the throttling control.

When the blow-by gas feedback device 15 is normal, the upstream intake air amount QA immediately decreases well in response as the throttling control is started for the intake air throttle valve 11, resulting in a smaller area of the region A, as shown in FIG. 5A. On the other hand, when the blow-by gas feedback device 15 is abnormal, part of a larger amount of intake air, which has been flowing through the intake pipe 4 by the start of the throttling control, loses where to go, and flows out from a location at which the blow-by gas passage 16 comes off, so that the intake air amount QA slowly decreases, resulting in a larger area of the region A, as shown in FIG. 5B.

As described above, according to this embodiment, the intake air amount at a location downstream of the joint 30 of the intake pipe 4 is forcedly changed to decrease by throttling controlling the intake air throttle valve 11 (step 8), and the intake air changing amount SCQAR is calculated based on the intake air amount QA subsequently detected by the air flow meter 22 at a location upstream of the joint 30 (step 20). Then, the intake air changing amount SCQAR is equal to or larger than the threshold value QAREF (NO at step 21), the blow-by gas feedback device 15 is determined to be abnormal, thus making it possible to appropriately determine the abnormality and improve the determination accuracy.

Also, when the intake air changing amount SCQAR is calculated based on the intake air amount QA, the intake air amount QA is corrected in accordance with the engine rotational speed NE, so that even if the engine rotational speed NE changes, the intake air amount QA can be calculated with reference to the reference rotational speed NEO, thereby further improving the accuracy of the abnormality determination.

Further, since the post-correction intake air amount accumulation value SCQA is calculated by accumulating the post-correction intake air amount CQA, it is possible to prevent erroneous determinations due to temporary fluctuations in the intake air amount QA, the influence of noise included in the detection signal of the intake air amount QA, and the like, to further improve the determination accuracy.

Also, since the intake air changing amount SCQAR is calculated by subtracting the product of the final value CQAF and the number of times N of accumulations from the post-correction intake air amount accumulation value SCQA, the abnormality determination can be made based on a net changing amount in accordance with the throttling control, thus further improving the accuracy of the abnormality determination.

Further, since the existing air flow meter 22, which is generally used for controlling the engine 3, is utilized as an intake air amount sensor for detecting the intake air amount QA, the abnormality determination can be made without adding a dedicated device for the abnormality determination.

Also, since the abnormality determination is executed under the condition that the engine 3 is in the fuel cut operation or in the cruising operation, its accuracy can be further improved by executing the abnormal determination only when the intake air amount is stable.

Further, since the EGR control valve 7*b* and the variable vane 8*c* are both controlled to close during the abnormality determination, the influence on the intake air amount due to their operations can be eliminated, thus making it possible to more appropriately perform the abnormality determination.

Figure 6:
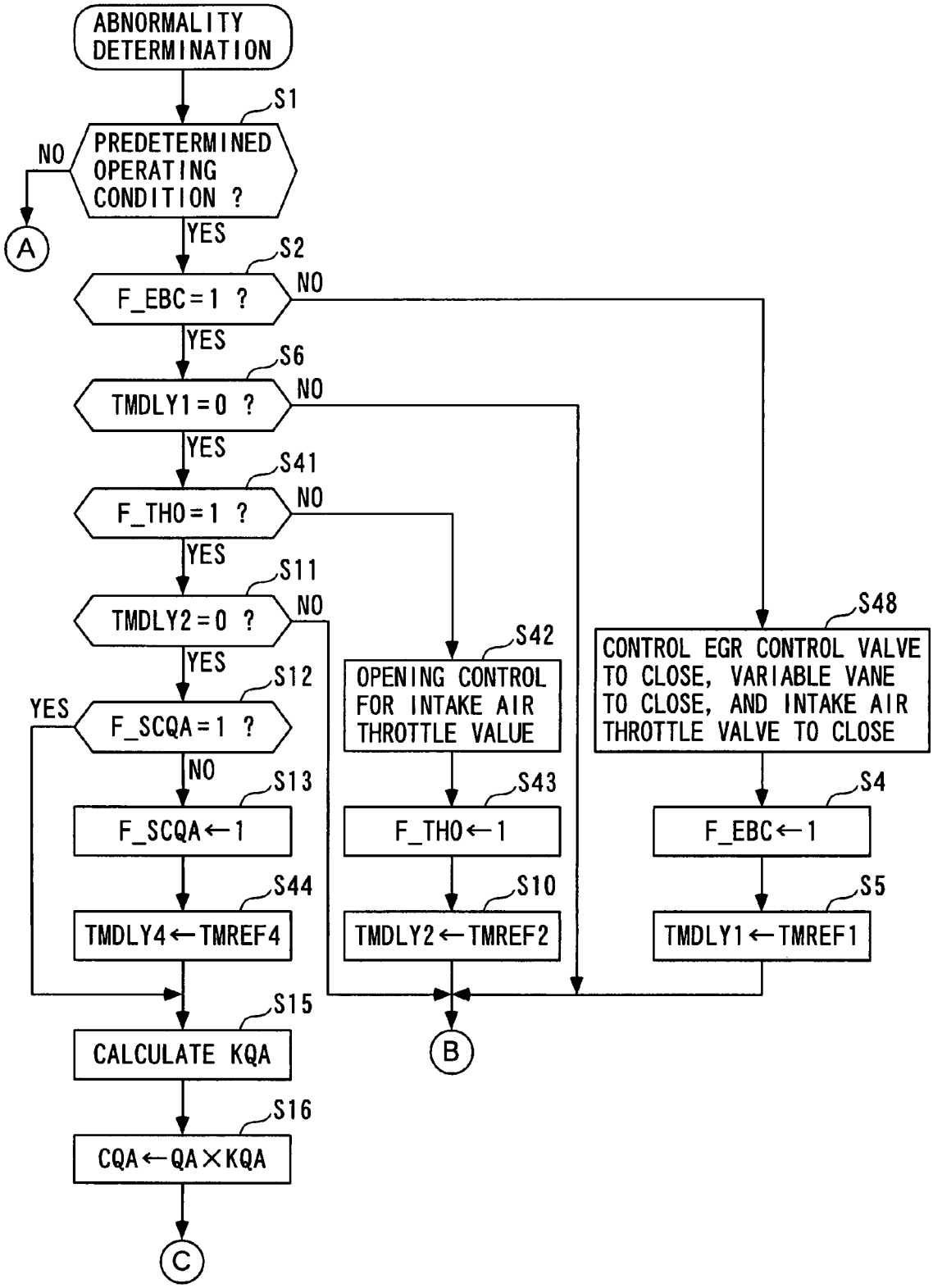
FIG. 6 is a flow chart showing an abnormality determination process for the blow-by gas feedback device according to a second embodiment of the present invention.
Figure 7:
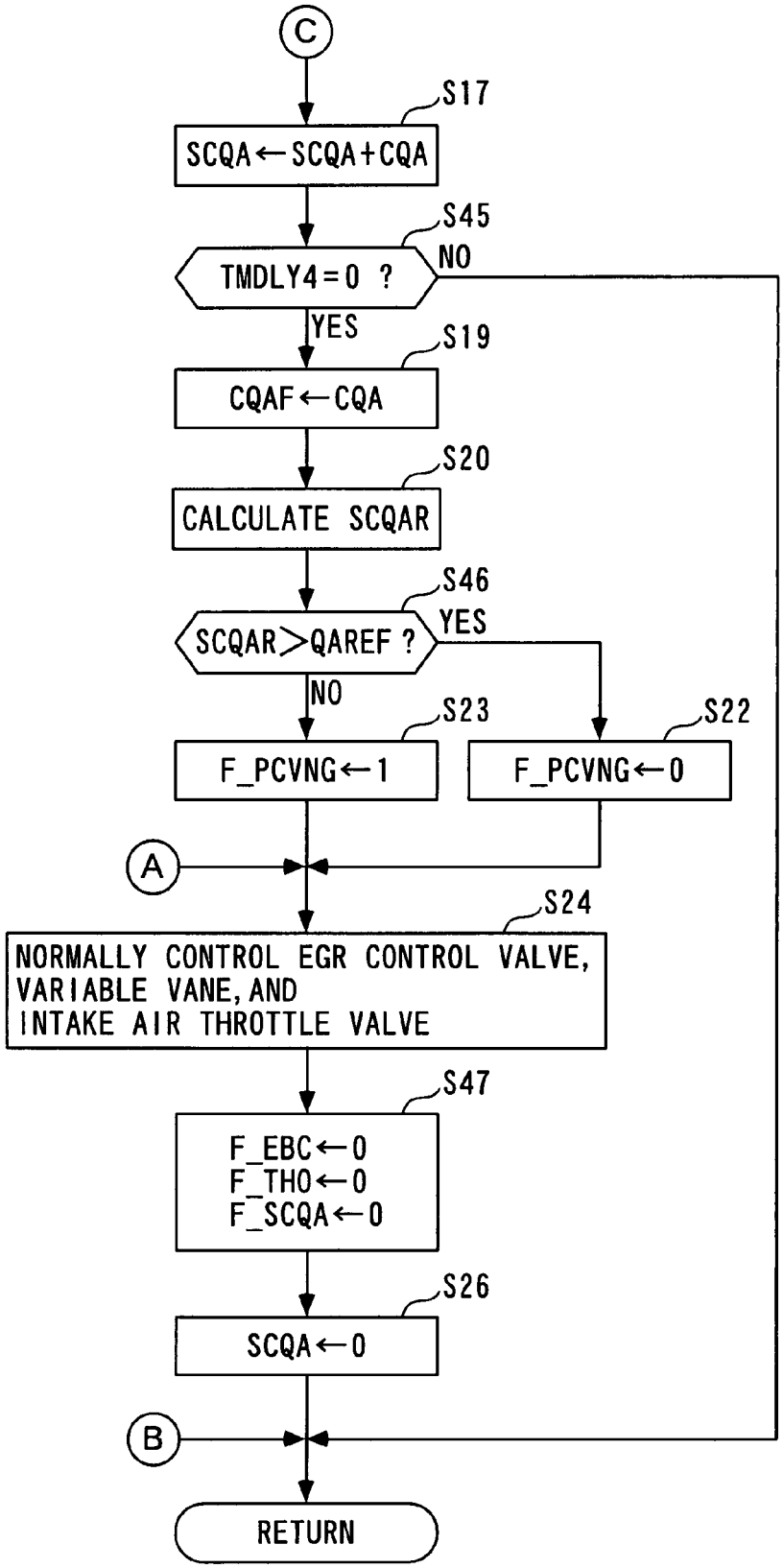
FIG. 7 is a flow chart continued from FIG. 6.

FIGS. 6 and 7 are flow charts showing an abnormality determination process for the blow-by gas feedback device 15 according to a second embodiment of the present invention. As can be understood from a comparison of these FIGS. 6 and 7 with FIGS. 2 and 3, they largely differ in that in the abnormality determination process of the first embodiment, the abnormality determination is executed while the intake air throttle valve 11 is controlled to close, whereas in the second embodiment, the abnormality determination is executed while the intake air throttle valve 11 is controlled to open. As such, in the following description, the same execution contents as those in the first embodiment are designated the same step numbers in the figures, and the description will be centered on different execution contents.

In this process, when the engine 3 is in a predetermined operating condition (YES at step 1), and when the valve close control flag F_EBC is not "1" (NO at step 2), the EGR control valve 7*b* and the variable vane 8*c* are controlled to close in a manner similar to the aforementioned step 3, and the intake air throttle valve 11 is also controlled once to a predetermined opening smaller than that for the normal control (valve closing operation). Then, when their valve closing control continues for the first predetermined time TMREF1 (YES at step 6), it is determined whether or not an opening control flag F_THO is "1" (step 41). When the result of this determination is NO, the intake air throttle valve 11 is controlled to a predetermined opening larger than that of the valve closing operation so far performed (hereinafter called the "opening control"), and the opening control flag F_THO is set to "1" (step 43), followed by the execution of the aforementioned step 10. In this way, the intake air amount is controlled to increase.

As the step 43 is executed, the result of the determination at step 41 is YES, in which case it is determined whether or not the second timer value TMDLY2 is zero (step 11). When the result of this determination is YES, the accumulation flag F_SCQA is "1" (step 12). When the result of this determination is NO, the accumulation flag F_SCQA is set to "1" (step 13), and a fourth timer value TMDLY4 is set to a fourth predetermined time TMREF4 (for example, 0.3 sec) significantly shorter than the third predetermined time TMREF3 (step 44). Then, the post-correction intake air amount accumulation value SCQA is calculated (steps 15-17). After the start of this calculation, when the fourth predetermined time TMREF4 has elapsed (YES at step 45), it is determined whether or not the calculated intake air amount SCQAR is larger than a predetermined threshold value QAREF (step 46).

When the result of this determination is YES, the abnormality flag F_PCVNG is se to "0" (step 22). On the other hand, when the result of the determination at step 46 is NO, indicating SCQAR≦QAREF, the intake air changing amount SCQAR is small, and the blow-by gas feedback device 15 is determined to be abnormal on the assumption that air can be flowing due to the blow-by gas passage 16 coming off the intake pipe 4. Then, the abnormality flag F_PCVNG is set to "1" for indicating this fact (step 23). At step 24 subsequent to step 22 or 23, after the EGR control valve 7*b*, the variable vane 8*c*, and the intake air throttle valve 11 are normally controlled, the valve closing flag F_EBC, the opening control flag F_THO, and the accumulation flag F_SCQA are all set to "0" (step 47), and the post-correction intake air amount accumulation value SCQA is reset to zero (step 26), followed by the termination of this process.

Figures 8A, 8B:
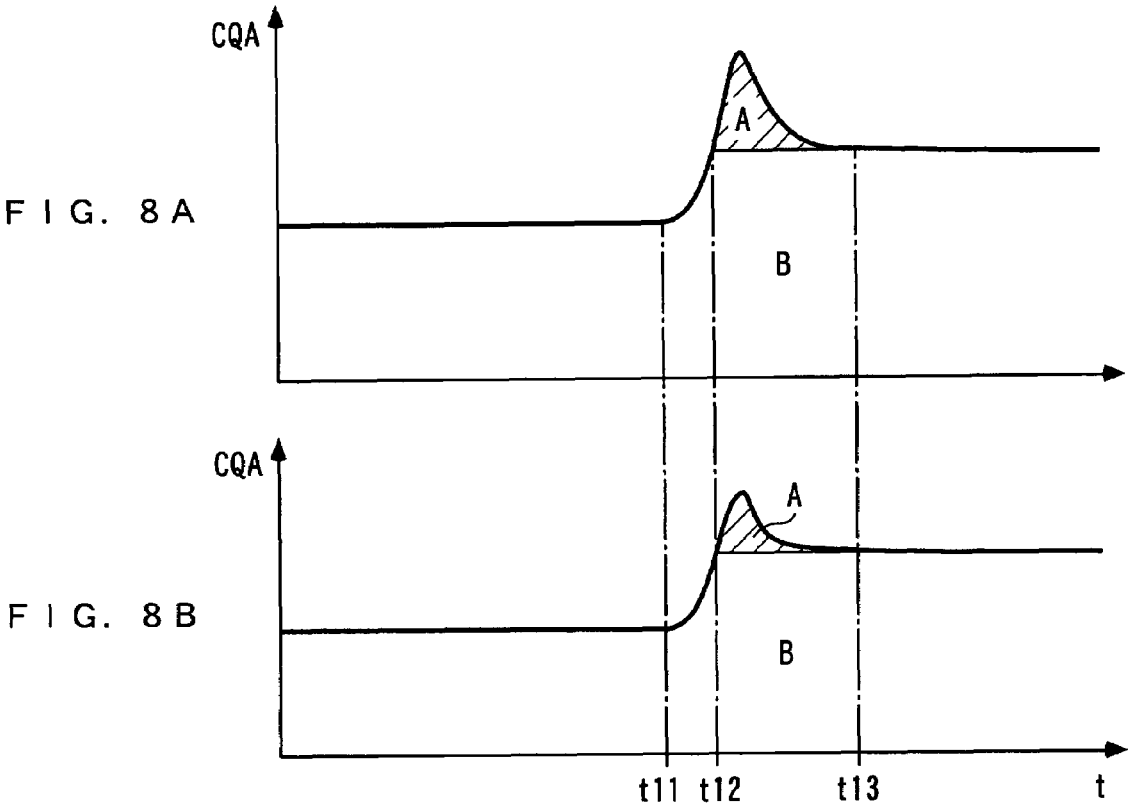
FIGS. 8A and 8B are diagrams showing exemplary changes in corrected intake air amount associated with opening control of the throttle valve when the blow-by gas feedback device is normal (A) and abnormal (B).

FIGS. 8A and 8B show exemplary changes in the post-correction intake air amount CQA associated with the opening control for the intake air throttle valve 11 when the blow-by gas feedback device 15 is normal (A) and when abnormal (B). The opening control is started for the intake air throttle valve 11 (timing t11), and the calculation of the post-correction intake air amount accumulation value SCQA is started when the second predetermined time TMREF2 has elapsed after the start of the opening control (t12), and the calculation is terminated when the very short fourth predetermined time TMREF4 has elapsed after the start of the calculation (t13).

The post-correction intake air amount CQA abruptly rises immediately after the start of the opening control for the intake air throttle valve 11. When the blow-by gas feedback device 15 is normal, a rising amount is large as shown in FIG. 8A, whereas when the blow-by gas feedback device 15 is abnormal, the rising amount is small as shown in FIG. 8B because air flows in from a location at which the blow-by gas passage 16 comes off, and the intake air amount QA decreases in correspondence. The intake air changing amount SCQAR calculated at the aforementioned step 20 indicates this rising amount of the intake air amount QA, and becomes smaller when the blow-by gas feedback device 15 is abnormal as shown in FIG. 8B.

As described above, according to this embodiment, the intake air amount at a location downstream of the joint 30 of the intake pipe 4 is forcedly changed to increase by controlling the intake air throttle valve 11 to open (step 42), and when the intake air changing amount SCQAR indicative of the rising amount of the intake air amount QA, calculated based on the intake air amount QA detected immediately after the opening control, is equal to or smaller than the threshold value QAREF (NO at step 46), the blow-by gas feedback device 15 is determined to be abnormal. Accordingly, abnormalities of the blow-by gas feedback device 15 can be appropriately determined based on the rising amount immediately after the opening control for the intake air throttle valve 11, thus providing similar advantages to those of the first embodiment.

It should be understood that the present invention is not limited to the described embodiments, but can be practiced in a variety of manners. For example, while the intake air throttle valve 11 is used as an intake air amount controller for changing the intake air amount, for which the throttling control and opening control are performed in the first and second embodiments, respectively, another appropriate intake air amount controller may be used instead of or in addition to the intake air throttle valve. For example, the EGR amount may be increased/decreased by controlling the EGR control valve 7*b* of the EGR device 7, or the supercharge pressure may be increased/decreased by controlling the variable vane 8*c* of the supercharger 8. In this event, the intake air amount controller which is not used to change the intake air amount is preferably held in a predetermined operating condition so as not to affect the intake air amount, in a manner similar to the EGR control valve 7*b* and the variable vane 8*c* which are controlled to close in the embodiments.

Also, in the embodiments, the intake air amount is forcedly changed by the throttling control or the opening control for the intake air throttle valve. The present invention is not so limited, but the abnormality determination may be performed by capturing a timing at which the opening of the intake air throttle valve 11 changes to the accompaniment of a manipulation of a driver on an accelerator pedal.

Further, while the embodiments employ the accumulation value of the post-correction intake air amount CQA as a parameter for performing the abnormality determination, the present invention is not so limited, but may use the intake air amount QA or the post-correction intake air amount CQA detected at a predetermined timing after the start of the throttling control or the opening control for the intake air throttle valve 11. In the former case, the threshold value to be compared with the intake air amount QA is preferably set in accordance with the engine rotational speed NE.

Further, while the foregoing embodiment has shown an example in which the present invention is applied to a diesel engine, the present invention is not limited to this particular engine, but can be applied to a variety of engines other than the diesel engine, including an engine for vessel propeller such as an outboard engine which has a crank shaft arranged in the vertical direction. Otherwise, details in the configuration may be modified as appropriate without departing from the spirit and scope of the present invention.

What is claimed is:

1. An abnormality determination apparatus for a blow-by gas feedback device for feeding a blow-by gas back to an intake system of an internal combustion engine through a blow-by gas passage connected to the intake system through a joint, comprising:

an intake air amount sensor provided in said intake system at a location upstream of said joint for detecting an intake air amount;

an intake air amount controller provided in said intake system at a location downstream of said joint for controlling the intake air amount; and abnormality determining means for determining an abnormality of said blow-by gas feedback device based on the intake air amount detected by said intake air amount sensor after the intake air amount has changed due to the operation of said intake air amount controller.

2. An abnormality determination apparatus for a blow-by gas feedback device according to claim 1, wherein:

said abnormality determining means comprises changing degree calculating means for calculating a changing degree of the intake air amount based on the intake air amount detected after the intake air amount has changed; and said abnormality determining means determines an abnormality of said blow-by gas feedback device based on the changing degree of the intake air amount calculated after the intake air amount has changed to decrease.

3. An abnormality determination apparatus for a blow-by gas feedback device according to claim 1, wherein:

said abnormality determining means comprises changing degree calculating means for calculating a changing degree of the intake air amount based on the intake air amount detected after the intake air amount has changed; and said abnormality determining means determines an abnormality of said blow-by gas feedback device based on the changing degree of the intake air amount calculated immediately after the intake air amount has changed to increase.

4. An abnormality determination apparatus for a blow-by gas feedback device according to claim 2 or 3, wherein:

said changing degree calculating means calculates an accumulation value of the intake air amount detected in a predetermined period after the intake air amount has changed as a parameter indicative of the changing degree of the intake air amount; and said abnormality determining means determines an abnormality of said blow-by gas feedback device based on the calculated accumulation value of the intake air amount.

5. An abnormality determination apparatus for a blow-by gas feedback device according to claim 1, further comprising:

rotational speed detecting means for detecting a rotational speed of said internal combustion engine; and an intake air amount correcting means for correcting the detected intake air amount to be smaller as the detected rotational speed is higher.

6. An abnormality determination apparatus for a blow-by gas feedback device according to claim 1, further comprising:

operating condition detecting means for detecting an operating condition of said internal combustion engine, wherein said abnormality determining means executes an abnormality determination for said blow-by gas feedback device when the detected operating condition is a predetermined operating condition.

7. An abnormality determination apparatus for a blow-by gas feedback device according to claim 1, wherein:

said intake air amount controller comprises a plurality of intake air amount controllers; and said apparatus further comprises a control means for controlling at least one of said plurality of intake air amount controllers to change the intake air amount, and holding remaining ones of said intake air amount controllers in a predetermined operating condition such that said remaining intake air amount controllers do not affect the intake air amount, when the abnormality determination is executed.

8. An abnormality determination method for a blow-by gas feedback device for feeding a blow-by gas back to an intake system of an internal combustion engine through a blow-by gas passage connected to the intake system through a joint, said method comprising the steps of:

detecting an intake air amount by an intake air amount sensor provided in said intake system at a location upstream of said joint;

controlling the intake air amount by an intake air amount controller provided in said intake system at a location downstream of said joint; and determining an abnormality of said blow-by gas feedback device based on the intake air amount detected by said intake air amount sensor after the intake air amount has changed due to the operation of said intake air amount controller.

9. An abnormality determination method for a blow-by gas feedback device according to claim 8, wherein:

said step of determining an abnormality includes:

calculating a changing degree of the intake air amount based on the intake air amount detected after the intake air amount has changed; and determining an abnormality of said blow-by gas feedback device based on the changing degree of the intake air amount calculated after the intake air amount has changed to decrease.

10. An abnormality determination method for a blow-by gas feedback device according to claim 8, wherein:

said step of determining an abnormality includes:

calculating a changing degree of the intake air amount based on the intake air amount detected after the intake air amount has changed; and determining an abnormality of said blow-by gas feedback device based on the changing degree of the intake air amount calculated immediately after the intake air amount has changed to increase.

11. An abnormality determination method for a blow-by gas feedback device according to claim 9 or 10, wherein:

said step of determining an abnormality includes:

calculating an accumulation value of the intake air amount detected in a predetermined period after the intake air amount has changed as a parameter indicative of the changing degree of the intake air amount; and determining an abnormality of said blow-by gas feedback device based on the calculated accumulation value of the intake air amount.

12. An abnormality determination method for a blow-by gas feedback device according to claim 8, further comprising the steps of:

detecting a rotational speed of said internal combustion engine; and correcting the detected intake air amount to be smaller as the detected rotational speed is higher.

13. An abnormality determination method for a blow-by gas feedback device according to claim 8, further comprising the step of:

detecting an operating condition of said internal combustion engine; and executing an abnormality determination for said blow-by gas feedback device when the detected operating condition is a predetermined operating condition.

14. An abnormality determination method for a blow-by gas feedback device according to claim 8, wherein:

said intake air amount controller comprises a plurality of intake air amount controllers; and said method further comprises the step of controlling at least one of said plurality of intake air amount controllers to change the intake air amount, and holding remaining ones of said intake air amount controllers in a predetermined operating condition such that said remaining intake air amount controllers do not affect the intake air amount, when the abnormality determination is executed.

15. An engine control unit including a control program for determining an abnormality of a blow-by gas feedback device for feeding a blow-by gas back to an intake system of an internal combustion engine through a blow-by gas passage connected to the intake system through a joint, said control program causing a computer to detect an intake air amount by an intake air amount sensor provided in said intake system at a location upstream of said joint; control the intake air amount by an intake air amount controller provided in said intake system at a location downstream of said joint; and determine an abnormality of said blow-by gas feedback device based on the intake air amount detected by said intake air amount sensor after the intake air amount has changed due to the operation of said intake air amount controller.

16. An engine control unit according to claim 15, wherein said control program further causes the computer to calculate a changing degree of the intake air amount based on the intake air amount detected after the intake air amount has changed; and determine an abnormality of said blow-by gas feedback device based on the changing degree of the intake air amount calculated after the intake air amount has changed to decrease.

17. An engine control unit according to claim 15, wherein said control program further causes the computer to calculate a changing degree of the intake air amount based on the intake air amount detected after the intake air amount has changed; and determine an abnormality of said blow-by gas feedback device based on the changing degree of the intake air amount calculated immediately after the intake air amount has changed to increase.

18. An engine control unit according to claim 16 or 17, wherein said control program further causes the computer to calculate an accumulation value of the intake air amount detected in a predetermined period after the intake air amount has changed as a parameter indicative of the changing degree of the intake air amount; and determine an abnormality of said blow-by gas feedback device based on the calculated accumulation value of the intake air amount.

19. An engine control unit according to claim 15, wherein said control program further causes the computer to detect a rotational speed of said internal combustion engine; and correct the detected intake air amount to be smaller as the detected rotational speed is higher.

20. An engine control unit according to claim 15, wherein said control program further causes the computer to detect an operating condition of said internal combustion engine; and execute an abnormality determination for said blow-by gas feedback device when the detected operating condition is a predetermined operating condition.

21. An engine control unit according to claim 15, wherein said intake air amount controller comprises a plurality of intake air amount controllers, and said control program further causes the computer to control at least one of said plurality of intake air amount controllers to change the intake air amount, and holding remaining ones of said intake air amount controllers in a predetermined operating condition such that said remaining intake air amount controllers do not affect the intake air amount, when the abnormality determination is executed.

* * * * *